US005692261A

United States Patent [19]

Lops

[11] Patent Number: 5,692,261

[45] Date of Patent: Dec. 2, 1997

[54] HAND HELD LOTION APPLICATOR

[76] Inventor: Mary Grace Lops, 4 Homstead Path, Huntington, N.Y. 11743

[21] Appl. No.: 591,257

[22] Filed: Jan. 19, 1996

[51] Int. Cl.[6] ..... A47K 7/02

[52] U.S. Cl. ..... 15/209.1; 15/185; 15/244.1; D28/7

[58] Field of Search ..... 15/104.94, 144.1, 15/144.3, 185, 209.1, 210.2, 244.1, 244.2, 143.1; 132/312; 206/38, 364, 581; 401/6, 7; D28/7

[56] References Cited

U.S. PATENT DOCUMENTS

| | | | |
|---|---|---|---|
| D. 137,184 | 2/1944 | Weyenberg | 206/38 X |
| D. 375,816 | 11/1996 | Long-Langworthy | D28/7 |
| 2,053,167 | 9/1936 | Schneider | 15/185 |
| 4,299,005 | 11/1981 | Brown | 15/244.2 |
| 4,381,766 | 5/1983 | Avolio | 15/210.1 X |
| 4,941,226 | 7/1990 | Kemper | 15/185 |
| 5,360,111 | 11/1994 | Arispe | 401/6 X |
| 5,437,372 | 8/1995 | Per-lee | 206/581 |
| 5,441,153 | 8/1995 | Lahaye | 206/581 |
| 5,493,749 | 2/1996 | Zayas | 15/244.1 X |
| 5,566,418 | 10/1996 | Steffen et al. | 15/244.1 |

*Primary Examiner*—Mark Spisich
*Attorney, Agent, or Firm*—Bauer & Schaffer

[57] ABSTRACT

A foldable, elongated handle is provided at one end with a pad to which may be applied a lotion or cream.

3 Claims, 2 Drawing Sheets

HAND HELD LOTION APPLICATOR

RELATED APPLICATION

Additional subject matter concerning the present application is contained in Disclosure Document No. 374,258, filed Apr. 13, 1995.

BACKGROUND OF THE INVENTION

The present invention relates to lotion applicators and more specifically, to a hand held lotion applicator that allows the user to apply a lotion or skin cream to his or her own back without the aid of another person.

Lotion applicators have come in many forms ranging from one's own hand to cloth rags to hand held pads. These devices are well suited for their uses but do not accomplish one unfulfilled but valuable need. This need, is the ability to apply skin lotion or cream to one's own back without the aid of another person.

Other devices that allow the user to reach a hard-to-reach area of the back for other purposes do exist. These include an extended-arm scrub brush and a back scratcher, but neither of these can aid in the application of lotion cream to that hard-to-reach area of the back, since a person's own arms are not long enough to apply lotion or cream to that hard-to-reach area of the central part of the back.

It is the object of the present invention to provide a simple applicator by which the user may apply lotion or cream to those hard-to-reach areas on one's own back without the aid of another person.

These advantages, together with other advantages and objects will become apparent from the following disclosure of the present invention.

SUMMARY OF THE INVENTION

According to the present invention a thin, foam rubber, washable applicator pad is attached to a long arm collapsible handle. Lotion or cream is applied to the applicator pad and can then be applied to the back of the user. The applicator pad is made of a washable material so that the lotion or cream may be removed and the pad cleansed as desired. The handle is formed of two arms hinged that they may be closed upon each other by folding them thus to form a thin compact device for easy and convenient storage. The pad is covered by the ends of the folded handle thereby preventing the applicator pad from prematurely drying out or the lotion from caking or flaking off, between uses and/or cleansing.

For a more complete understanding of the nature and objects of the invention, reference should be made to the attached drawings illustrating the detailed description set forth hereinafter.

DESCRIPTION OF THE PREFERRED EMBODIMENT

Figure 1:
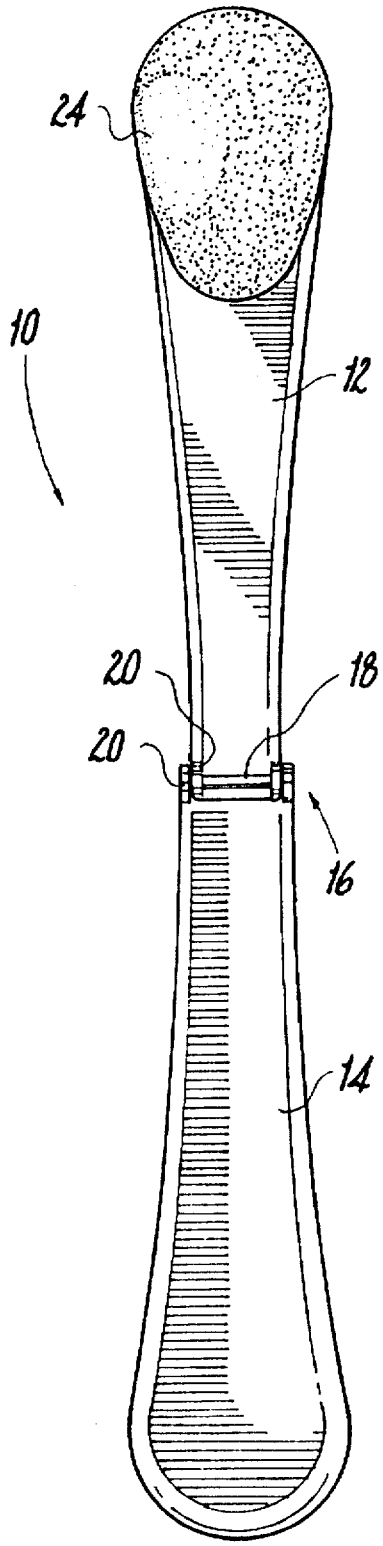
FIG. 1 depicts a front open view of the complete applicator of the present invention showing a front of an applicator pad, an inside upper arm, a hinge and an inside lower arm.
Figure 2:
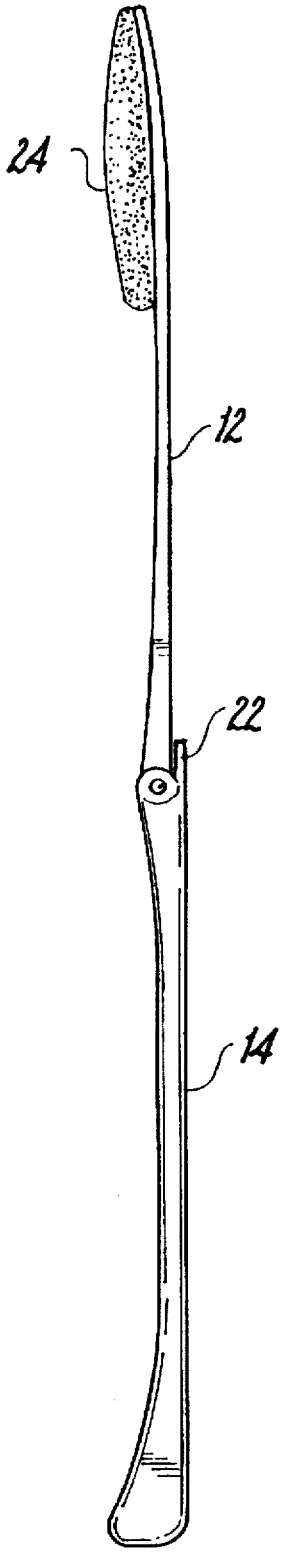
FIG. 2 depicts a side open view of the invention showing a side of the applicator pad, a side of the upper arm, a hinge pin, a side of the hinge stop and a side of the lower arm.

As depicted in the figures, the applicator generally indicated by the numeral 10 is formed of two hinged arms, an upper arm 12 and a lower arm 14 connected by a hinge 16, the pin 18 of which is journalled in the abutting side walls 20. The walls 20 bent slightly in toward each other to create an over-the center snap action that allows the upper and lower arms to rotate around the hinge pin 18 to unfold and open the applicator to its full linear extent, and then to fold and close each arm onto each other forming a compact assembly. A hinge stop 22 (FIG. 2) is provided to prevent the upper and lower arms from rotating around the hinge pin past the 180 degree point. The hinge stop 22, in turn, provides support for the upper arm during the application process, when the arms are extended.

The front face is textured and has a thin peripheral edge so as to be comfortable to the touch. The rear surface is flat to enable the pad to be glued or otherwise comfortably secured in the recess of the handle. The pad may be made of fabric, sponge or the other porous material. At the extreme free end of the upper arm there is formed a shallow tear drop recess into which an applicator pad 24 fits. The applicator pad is preferably made of a foam or absorbent rubber or rubber substitute having a dome shaped front face and a flat rear surface.

The user applies lotion or cream onto and into the pad and the applicator may then be stored for an extended period. When used the applicator is opened and extended so that the user may apply the pad to his or her back by positioning the applicator pad over a hard-to-reach area of the back while holding onto the lower arm. The total length of the opened application being of enough length to cover all hard-to-reach areas of the back. The applicator pad is made such of such a material so that it can be washed to remove any excess lotion or cream after use as desired.

Figure 3:
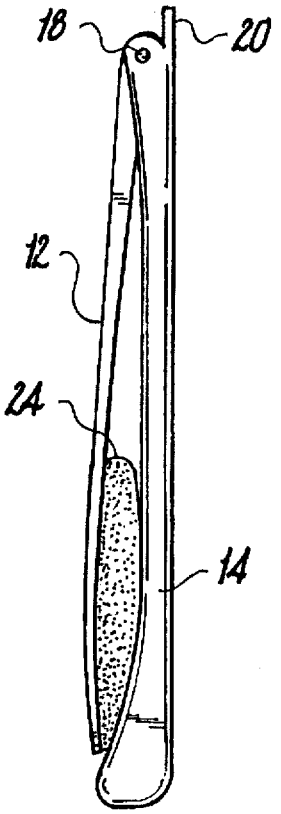
FIG. 3 depicts a side closed view of the invention showing the hinge stop, the hinge pin, the side of the lower arm, the side of the upper arm and the side of the applicator pad.
Figure 4:
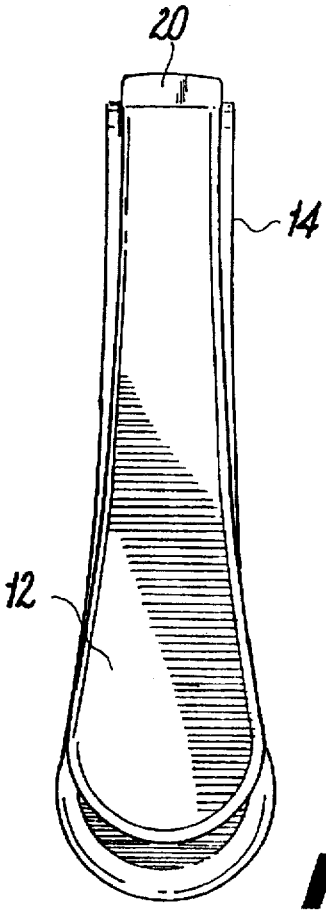
FIG. 4 depicts a front closed view of the invention showing the hinge stop, the outside of the upper arm and an outer edge of the inside of the lower arm.

As seen, the upper arm 12 is slightly smaller than the lower arm 14 so that the applicator pad may be folded into the lower arm. The lower arm 14, also somewhat thicker and shaped so that it may be easily grasped by the user. It may also be shaped to provide a recess to conform to the shape of the upper arm to receive the upper arm and the applicator pad for easy of storage and transport. (see FIGS. 3 and 4).

Figure 5:
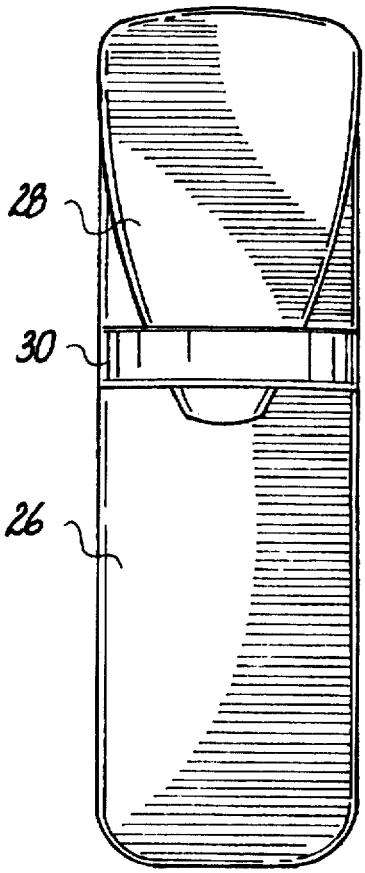
FIG. 5 depicts a plastic storage envelope used to store, and for convenient carrying of, the invention when not in use showing an envelope flap, a flap strap and a body of the envelope.

A plastic envelope 26 (FIG. 5) is also provided. The envelope 26 is slightly larger than the applicator 10 in its compacted state so that when the applicator is folded it can be inserted completely into the plastic envelope. The envelope 26 has an envelope flap 28 and a flap strap 30 to secure the flap in the closed position. In lieu of the flap strap, other flap securing means, such as a Velcro strip, can be employed to secure the envelope flap in its closed position.

It shall be noted that all of the above description and accompanying drawings of the invention are to be considered illustrative and are not to be considered in the limiting sense. It is also understood that the following claims are intended to cover all of the generic and specific embodiments and features of the invention herein described.

What is claimed is:

1. A lotion applicator comprising a handle having an elongated first arm and second arm only slightly larger than said first arm, said arms being hingedly joined together by means of a hinge at one of their respective ends so as to fold one over the other, an applicator pad having opposed faces and a thin peripheral edge secured by one of its faces to said first arm adjacent the free end thereof, the second arm having adjacent its free end and spaced from the hinged end thereof a recess formed therein conforming in size and shape to that of said pad to thereby receive and substantially envelop said pad when said arms are folded.

2. The structure in claim 1, wherein said handle is of a length long enough to reach all of a back of a user.

3. The structure in claim 1, wherein said hinge includes a hinge pin, and said first arm and second arm have inward bent edges, said hinge end of the first arm and second arm having a hole on each bent edge of said respective arms through which said hinge pin is inserted and secured to provide said hinging means, a hinge stop at said hinge end of said second arm to prevent rotation of said first arm beyond a predetermined point.

* * * * *